US008301067B2

(12) United States Patent
Takada

(10) Patent No.: US 8,301,067 B2
(45) Date of Patent: Oct. 30, 2012

(54) IMAGE HEATING APPARATUS

(75) Inventor: Shigeaki Takada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 13/021,321

(22) Filed: Feb. 4, 2011

(65) Prior Publication Data

US 2011/0135352 A1 Jun. 9, 2011

Related U.S. Application Data

(63) Continuation of application No. PCT/JP2009/064327, filed on Aug. 7, 2009.

(30) Foreign Application Priority Data

Aug. 8, 2008 (JP) ..... 2008-206040

(51) Int. Cl.
*G03G 15/20* (2006.01)

(52) U.S. Cl. ..... 399/324; 399/327; 399/333

(58) Field of Classification Search ..... 399/324, 399/327, 333
See application file for complete search history.

(56) References Cited

U.S. PATENT DOCUMENTS 7,200,354 B2 4/2007 Nakamoto et al.
7,457,576 B2 11/2008 Takada et al.
7,466,950 B2 12/2008 Matsuura et al.
7,596,348 B2 9/2009 Nakamoto et al.
7,844,208 B2 11/2010 Hayashi et al.

FOREIGN PATENT DOCUMENTS

JP 6-282196 A 10/1994
JP 2002-62752 A 2/2002
JP 2003-91198 A 3/2003
JP 2004-037555 2/2004
JP 2005-164717 A 6/2005

OTHER PUBLICATIONS

International Search Report in PCT Application No. PCT/JP2009/064327/ issued Sep. 8, 2009, and English Translation.

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus includes: a heating rotatable member for heating a toner image on a recording material in a heating nip; a pressing rotatable member for forming the heating nip in contact with the heating rotatable member; a first external heater contacting an outer peripheral surface of the heating rotatable member having passed through the heating nip, for heating the outer peripheral surface, the first external heater including a parting layer; and a second external heater for heating the outer peripheral surface heated by the first external heating heater. The second external heater includes a surface parting layer containing an electroconductive agent. The contact angle of the parting layer of the first external heater with respect to water is larger than that of the parting layer of the second external heater, and the surface resistance of the second external heater is lower than that of the first external heater.

6 Claims, 4 Drawing Sheets

IMAGE HEATING APPARATUS

CROSS REFERENCE TO RELATED APPLICATION

This application is a continuation of PCT/JP2009/064327 filed Aug. 7, 2009, pending.

TECHNICAL FIELD

The present invention relates to an image heating apparatus in which a plurality of external heating members are disposed in contact with a heating rotatable member to be contacted to an image on a recording material, and specifically relates to a structure for maintaining the heating performance of surfaces of the external heating members for a long term.

BACKGROUND ART

An image heating apparatus in which a nip where the recording material is nipped is formed by causing a pressing member to press-contact a heating rotatable member (a fixing roller, a fixing belt, a pressing roller or a pressing belt) to be contacted to the image on the recording material at an outer peripheral surface thereof has been widely used. In a fixing device, which is an example of the image heating apparatus, the recording material on which a toner image is transferred is subjected to heating and pressing in a process in which the recording material is nipped and conveyed in a fixing nip and thus the toner image is melted and squashed to be fixed on the surface of the recording material as the image.

When the fixing speed is intended to be increased in such a fixing device, a lowering in surface temperature of the heating rotatable member by contact with the recording material cannot be remedied only by heating from an inner surface side. Further, it is also required to shorten the time until the surface temperature of the heating rotatable member reaches a necessary temperature after the fixing device is actuated.

For this reason, in Japanese Laid-Open Patent Application (JP-A) 2004-37555, a fixing device has been put into practical use in which a plurality of external heating members which rotate in contact with the outer peripheral surface of the heating rotatable member to directly heat the surface of the heating member are disposed from a recording material contact position along a rotational direction of the heating rotatable member.

Further, at the outer peripheral surface of the heating rotatable member, a parting layer for enhancing a parting property from melted toner is formed and therefore the outer peripheral surface of the heating rotatable member has a high resistance and is liable to be electrically charged by contact with the recording material.

When the fixing speed is intended to be increased in such a fixing device, the contact frequency with the recording material is increased and thus the outer peripheral surface of the heating rotatable member is charged to an excessive potential, so that there is a possibility that an unfixed toner image carried on the recording material is disturbed to lower image quality.

For this reason, JP-A 2002-62752 shows a fixing device constituted so as to discharge (charge-remove) the outer peripheral surface of the heating rotatable member by connecting an external heating member, lowered in resistance value by incorporating an electroconductive substance into a parting layer formed at a surface of the external heating member, to the ground potential.

As shown in JP-A 2002-62752, when the electroconductive substance is incorporated into the parting layer of the external heating member, the parting property of the parting layer is lowered, so that the surface of the external heating member is liable to be contaminated and thus melted toner or the like is liable to be carried on the external heating member surface. As a result, a normal contact state between the external heating member and the heating rotatable member is impaired, so that an original heating performance cannot be achieved.

Particularly, in the case where the plurality of external heating members are provided as disclosed in JP-A 2004-37555, contamination concentrates at an upstream-side external heating member, to which toner deposited on the heating rotatable member in the fixing nip is first contacted, with respect to the rotational direction of the heating rotatable member and therefore the heating performance is impaired in a short period.

DISCLOSURE OF THE INVENTION

An object of the present invention is to provide an image heating apparatus, including a plurality of external heating members, capable of maintaining the heating performance by the external heating members for a long term.

The present invention provides an image forming apparatus comprising:

a heating rotatable member for heating a toner image on a recording material in a heating nip;

a pressing rotatable member for forming the heating nip in contact with the heating rotatable member;

a first external heating member, contacted to an outer peripheral surface of the heating rotatable member having passed through the heating nip, for heating the outer peripheral surface, wherein the first external heating member includes a parting layer at a surface where the first external heating member is contacted to the outer peripheral surface; and a second external heating member for heating the outer peripheral surface heated by the first external heating member, wherein the second external heating member includes a parting layer containing an electroconductive agent at a surface where the second external heating member is contacted to the outer peripheral surface, wherein the contact angle of the parting layer of the first external heating member with respect to water is larger than that of the parting layer of the second external heating member, and the surface resistance of the second external heating member is lower than that of the first external heating member.

Further, the present invention provides an image forming apparatus comprising:

a heating rotatable member for heating a toner image on a recording material in a heating nip;

a pressing rotatable member for forming the heating nip in contact with the heating rotatable member;

a first external heating member, contacted to an outer peripheral surface of the heating rotatable member having passed through the heating nip, for heating the outer peripheral surface, wherein the first external heating member includes a parting layer at a surface where the first external heating member is contacted to the outer peripheral surface; and a second external heating member for heating the outer peripheral surface heated by the first external heating member, wherein the second external heating member includes a parting layer containing an electroconductive agent at a surface where the second external heating member is contacted to the outer peripheral surface, wherein the contact angle of the parting layer of the first external heating member with respect to water is larger than that of the parting layer of the second external heating member, and the proportion of the electroconductive agent to the parting layer of the second external heating member is larger than that of the first external heating member.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

Figure 1:
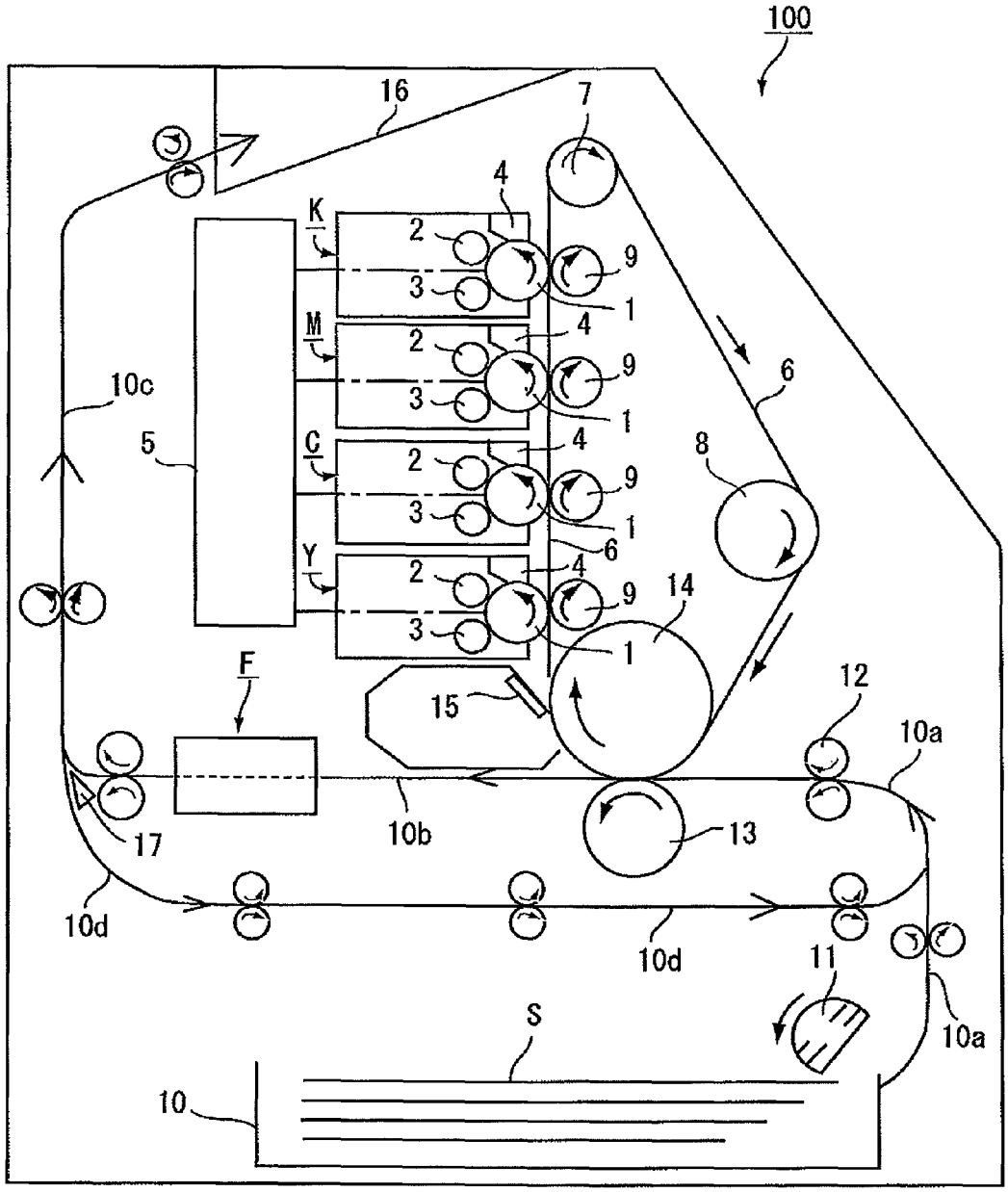
FIG. 1 is an illustration of a structure of an image forming apparatus in a First Embodiment.

Hereinbelow, several embodiments of the present invention will be described in detail with reference to the drawings. The present invention can also be carried out in other embodiments in which a part or all of constitutions of each embodiment is replaced with their alternative constitutions so long as a lower-side external heating member has a resistance lower than that of an upper-side external heating member.

In this embodiment, a fixing device for fixing an unfixed toner image on a recording material will be described but the present invention can also be carried out as a heat-treating device for adjusting a surface property of an image by heating and pressing the recording material on which a fixed image or a semi-fixed image is carried.

Incidentally, general matters of the image forming apparatus and the fixing device shown in Patent Document 1 (JP-A 2004-37555) will be omitted from illustration and redundant description. Further, reference numerals or symbols indicated in parentheses for names of constituents recited in the claims are examples for aiding the understanding of the present invention and are not intended to limit the constituents to corresponding members and the like in the embodiments.

<Image Forming Apparatus>

FIG. 1 is an illustration of a structure of the image forming apparatus in First Embodiment.

As shown in FIG. 1, an image forming apparatus 100 is a tandem type full-color laser beam printer in which image forming portions Y, C, M and K for yellow, magenta, cyan and black, respectively are disposed along an intermediary transfer belt 6.

The image forming portions Y, C, M and K are disposed in this order from a lower side to an upper side so as to transfer toner images onto the intermediary transfer belt 6, and include photosensitive drums 1 on which the toner images are formed, respectively, by using an electrophotographic process. At a periphery of each of the photosensitive drums 1, a charging device 2, a developing device 3, a primary transfer roller 9 and a cleaning device 4 are disposed along a rotational direction of the photosensitive drum 1. An exposure device 5 is disposed so as to subject the photosensitive drums 1 of the image forming portions Y, C, M and K to common exposure light by using a laser scanning exposure optical system.

At each of the image forming portions Y, C, M and K, by the exposure device 5, scanning exposure on the basis of image data is effected on the photosensitive drum 1 uniformly charged by the charging device 2, so that an electrostatic image corresponding to a scanning exposure image is formed on the surface of the photosensitive drum 1.

The developing device 3 develops the electrostatic image, formed on the surface of the photosensitive drum 1, as a toner image. Yellow toner, magenta toner, cyan toner and black toner are filled in the developing devices 3 of the image forming portions Y, C, M and K, respectively. For this reason, a yellow toner image, a cyan toner image, a magenta toner image and a black toner image are formed on the photosensitive drums 1 of the image forming portions Y, C, M and K, respectively.

The above-described single-color toner images formed (by development) on the respective photosensitive drums 1 of the image forming portions Y, C, M and K are primary-transferred successively and superposedly, in a predetermined alignment state, onto the intermediary transfer belt 6 which rotates at a constant speed in synchronism with the rotations of the photosensitive drums 1. By this, on the intermediary transfer belt 6, an unfixed full-color toner image is synthetically formed.

In a First Embodiment, an endless intermediary transfer belt 6 is used, and the intermediary transfer belt 6 is extended and stretched around a driving roller 7, a secondary transfer opposite roller 14 and a tension roller 8 and is rotationally driven by the driving roller 7.

A primary transfer roller 9 of each of the image forming portions Y, C, M and K urges the intermediary transfer belt 6 toward the photosensitive drum 1 to form a primary transfer portion of the toner image between the photosensitive drum 1 and the intermediary transfer belt 6.

An unshown bias voltage (power) source applies a primary transfer bias, of an opposite polarity to that of the toner, to the primary transfer roller 9. By this, the respective color toner images are primary-transferred from the photosensitive drums 1 of the image forming portions Y, C, M and K onto the intermediary transfer belt 6.

After the toner images are primary-transferred from the photosensitive drums 1 of the image forming portions Y, C, M and K onto the intermediary transfer belt 6, transfer residual toner remaining on each photosensitive drum 1 is removed by the cleaning device 4.

Such steps are performed in synchronism with the rotation of the intermediary transfer belt 6 by the image forming portions Y, C, M and K for yellow, cyan, magenta and black, so that the respective color toner images are primary-transferred successively and superposedly onto the intermediary transfer belt 6. Incidentally, during image formation of only a single color (single-color mode), the above-described steps are performed only with respect to the image forming portion for an intended color (e.g., the image forming portion K for black).

On the other hand, a recording material S set in a recording material cassette 10 is separated and fed one by one by a feeding roller 11, and passes through a conveying path 10*a* and stops in a state in which a leading end of the recording material S is contacted to registration rollers 12. The recording material S is conveyed on a center (line) basis. The registration rollers are actuated with predetermined control timing and send the recording material S to a secondary transfer portion which is a nip between the intermediary transfer belt 6 and a secondary transfer roller 13.

The secondary transfer roller 13 contacts the intermediary transfer belt 6 supported from the inside by the secondary transfer opposite roller 14 connected to the ground potential, thus forming the secondary transfer portion of the toner images onto the recording material S. The toner images which have been primary-transferred and superposed on the intermediary transfer belt 6 are secondary-transferred collectively onto the recording material S by applying to the secondary transfer roller 13 a bias of an opposite polarity to that of the toners by an unshown bias voltage source.

Secondary transfer residual toner which has passed through the secondary transfer portion and remains on the intermediary transfer belt 6 is removed by a belt cleaning device 15.

The recording material S on which the toner images have been secondary-transferred is curvature-separated from the intermediary transfer belt 6, and passes through a conveying path 10*b* to be introduced into a fixing device F, which is an example of the image heating apparatus. The fixing device F fixes the full-color image on the recording material S by melting and squashing the toner images in a process in which the recording material on which the toner images have been secondary-transferred is nip-conveyed while being heated and pressed.

The recording material S sent from the fixing device F passes through a conveying path 10*c* and is discharged on a sheet discharge tray 16 as a full-color print or a monochromatic (single-color) print.

<Image Heating Apparatus>

Figure 2:
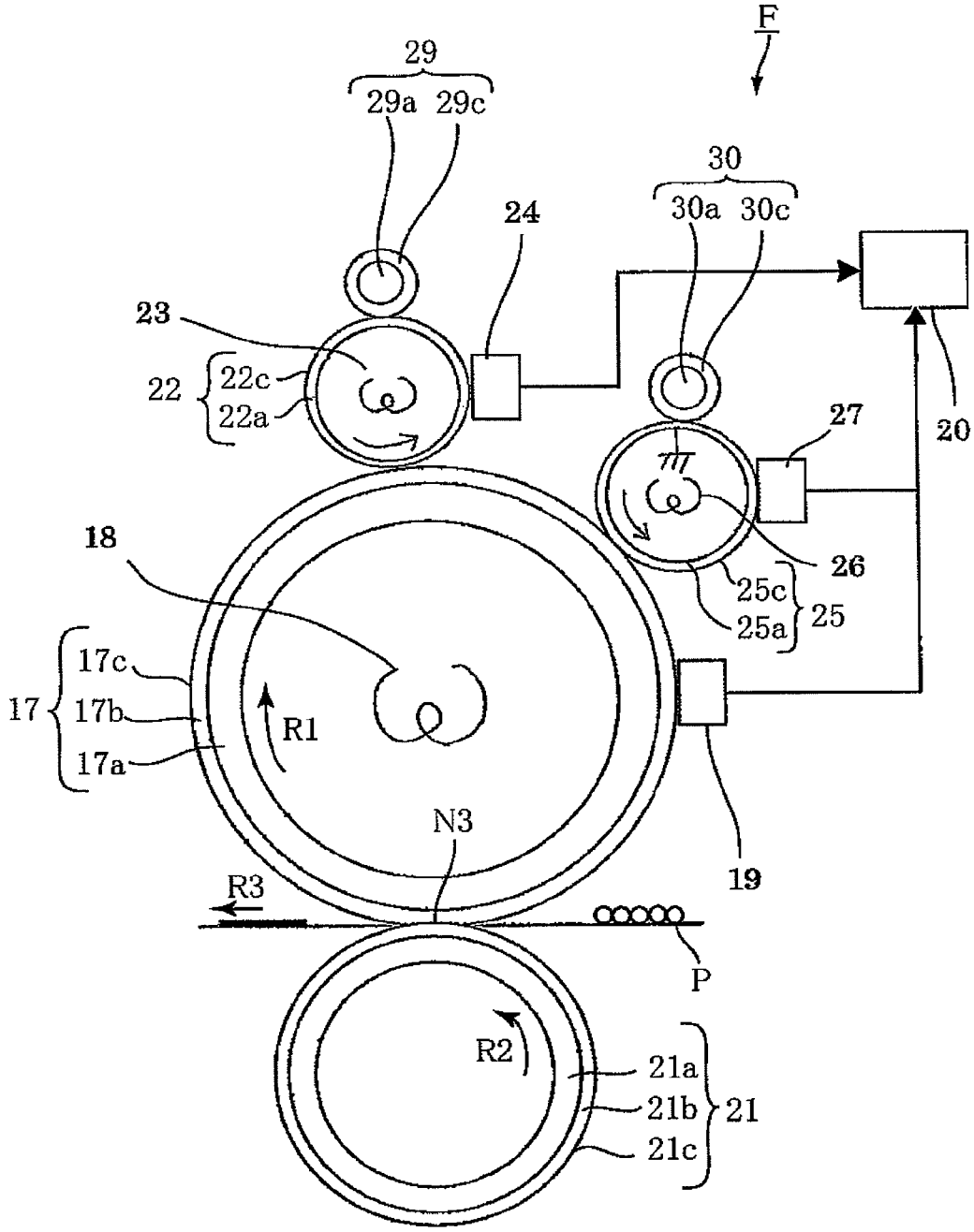
FIG. 2 is an illustration of a structure of a fixing device.

FIG. 2 is an illustration of a structure of the fixing device.

With respect to the fixing device in the image formation of the electrophotographic type, a heating-roller type has become common. In this type of device, the unfixed toner image is melt-fixed by nip-conveying the recording material and the toner electrostatically carried on the recording material at a press-contact portion between a rotating fixing roller and a pressing roller.

In the heating-roller type of fixing device, in order to keep image qualities (a fixing property, glossy feeding and the like) at a satisfactory level, the surface of the fixing roller is coated with an elastic layer of a silicone rubber or the like in many cases. Further, on the elastic layer, a parting layer of pertetrafluoroethylene (PTFE), perfluoroalkoxy (PFA) or the like is coated, so that a good parting property (releasability) with respect to the melted toner is ensured.

Further, also with respect to the pressing roller, the elastic layer of the silicone rubber or the like is coated in consideration of the image quality of two-side recording in many cases, and a good parting property is maintained by coating the parting layer on the elastic layer by the use of a material similar to that for the fixing roller.

In the heating-roller type fixing device, a heat source such as a halogen lamp is provided inside a cylinder of the fixing roller or the pressing roller, so that roller heating is effected by an inner surface heating method. In the case where the fixing roller including the elastic layer and the parting layer is heated by the inner-surface heating method, the thermal conductivity of the elastic layer and the parting layer is poor and therefore in the case where the recording material on which the unfixed toner image is carried is continuously passed between the fixing roller and the pressing roller, a temperature lowering of the fixing roller surface becomes conspicuous.

Even when a temperature detection sensor for detecting the surface temperature of the fixing roller detects the temperature lowering of the fixing roller surface and then the halogen lamp is turned on, much time is required until heat from the halogen lamp reaches the surface of the fixing roller. For this reason, the surface temperature of the fixing roller is continuously lowered until the heat from the halogen lamp is transmitted to the roller surface and then is below a minimum fixing-assuring temperature, so that improper fixing occurs.

As shown in FIG. 2, in the fixing device F in the First Embodiment, first and second external heating rollers 22 and 25 each including a heat source and using a substance having high thermal conductivity are press-contacted to the surface of the fixing roller 17 and are rotated. An external heating-type fixing device in which the fixing roller is directly heated from its surface by the first and second external heating rollers 22 and 25 is employed.

In the external heating-type fixing device, the surfaces of the first and second external heating rollers 22 and 25 are controlled at a temperature higher than that of the surface of the fixing roller 17. In press-contact nips between the first and second external heating rollers 22 and 25 and the fixing roller 17, the heat is directly transmitted from the external heating rollers 22 and 25 to the surface of the fixing roller 17 and therefore the temperature lowering of the fixing roller 17 can be effectively prevented compared with the inner-surface (internal), heating-type fixing device.

The fixing device F includes a fixing roller 17, also called a heating member, which is heated from an inner surface side and is to be contacted to the recording material on its surface side, and also includes a plurality of external heating roller members (22 and 25) which rotate in contact with the surface of the heating member. Further, a resistance value of the external heating roller member (25), located on a downstream side along a rotational direction of the heating member from a position (N3) in which the heating member is contacted to the recording material, is made lower than that of the external heating roller member (22) located on an upstream side. Further, each of the first and second external heating rollers 22 and 25 is connected to a charge-removable potential (ground potential).

The fixing roller 17 includes a metal core 17*a*, as a base layer, made of metal such as aluminum or iron and also includes a heat-resistant elastic layer 17*b* composed of a silicone rubber, a fluorine-containing rubber or the like, which is coated on the surface of the core metal 17*a*. Further, a surface layer of the elastic layer 17*b* is coated with a parting layer 17*c* constituted by a heat-resistant fluorine-containing tube. The fixing roller 17 is rotated by an unshown driving device and a rotational speed thereof is controlled.

The parting layer 17*c* does not contain an electroconductive agent such as carbon (black), and a surface resistivity of the surface of the fixing roller 17 is $1\times10^5$ Ωsq. Further, by using the fluorine-containing tube as the parting layer 17*c*, a high parting property is ensured at the surface. The surface of the fixing roller 17, i.e., the parting layer of the parting layer 17*c* has a contact angle with respect to water of 110 degrees. Incidentally, as the contact angle with respect to water is higher, the parting property with respect to toner becomes higher.

A heat source 18 is a heat generating element, such as the halogen heater or the like, disposed at the center of the fixing roller 17 and infrared-heats an inner surface of the metal core 17*a* of the fixing roller 17.

A thermistor 19 of a contact type detects the surface temperature of the fixing roller and is in contact with the surface of the fixing roller 17. The thermistor 19 may also be, e.g., a non-contact thermistor of an infrared detection type if the thermistor can accurately detect the surface temperature of the fixing roller 17.

A temperature control device 20 controls the output of the heat source 18 on the basis of a detection result of the thermistor 19, so that the surface temperature of the fixing roller 17 detected by the thermistor 19 is kept within a certain temperature range.

A pressing roller 21 is press-contacted to the fixing roller 17 by being urged toward a rotation shaft of the fixing roller 17 at both end portions of its rotation shaft by an unshown spring member, so that a fixing nip N3 for the recording material S is formed. The pressing roller 21 is, similarly as in the case of the fixing roller 17, formed by coating the surface layer of a metal core 21*a* with an elastic layer 21*b* and then by coating the outside of the elastic layer 21*b* with a parting layer 21*c*.

Here, the pressing roller 21 may be one containing the heat source at the inner portion of the metal core 21*a* or one containing no heat source but in the First Embodiment, the one containing no heat source is used for simplification.

Further, in the First Embodiment, the fixing roller 17, which is the example of a heating rotatable member is of the roller type, but may employ a belt-type heating member if the heating member can be press-contacted to the fixing member to form the fixing nip.

The elastic layer 17*b* of the fixing roller 17 is relatively thick and is low in thermal conductivity and therefore the elastic layer 17*b* constitutes an obstacle to heating the recording material S during the fixing of the toner image by heat supplied from the heat source of the fixing roller 17. In order to increase the speed with which the fixing device F fixes the toner image, one must realize that the thermal response is not performed in a timely manner when the supply of heat relies on only the heat source 18 of the fixing roller 17, making it difficult to keep the surface temperature of the fixing roller 17 constant.

For this reason, the first and second external heating rollers 22 and 25 are provided by being press-contacted to the fixing roller 17 so as to directly heat the surface of the heat fixing roller which has been lowered in temperature by the contact with the recording material S during the fixing of the toner image. By providing the two (first and second) external heating rollers 22 and 25, the quantity of heat provided to the surface of the fixing roller 17 is increased, and thus the speed-up of the fixing of the fixing device F is realized.

The first external heating roller 22 is disposed on the upstream side with respect to the rotational direction of the fixing roller 17 as seen from the fixing nip N3 and is press-contacted to the fixing roller 17 by being urged by an unshown urging mechanism. The first external heating roller 22 includes a metal core 22*a*, as a base layer, made of metal, such as aluminum or iron, and includes a heat-resistant parting layer 22*c* which is coated on the surface of the metal core 22*a* by fluorine-containing material coating.

The parting layer 22*c* of the first external heating roller 22 contains no electroconductive agent, similarly as in the parting layer 17*c* of the fixing roller 17. However, the parting layer 22*c* is thinner than the parting layer 17*c* of the fixing roller 17 and therefore the surface resistivity of the surface of the first external heating roller 22 is $1\times10^{12}$ to $1\times10^{14}$ Ωsq.

Further, the parting layer 22*c* is formed by the fluorine-containing material coating and therefore the contact angle with respect to water of the surface of the first external heating roller 22 is lower than that of the fixing roller 17 using the fluorine-containing tube. The surface of the first external heating roller 22, i.e., the parting layer 22*c* has the contact angle with respect to water of 95 degrees.

A heat source 23 is a heat generating element, such as the halogen heater or the like, incorporated into the first external heating roller 22 and infrared-heats an inner surface of the metal core 22*a* of the first external heating roller 22.

A thermistor 24 of a contact type detects the surface temperature in contact with the surface of the first external heating roller 22.

The temperature control device 20 controls the output of the heat source 23 on the basis of a detection result of the thermistor 24, so that the surface temperature of the first external heating roller 22 detected by the thermistor 24 is kept within a certain temperature range.

The second external heating roller 25 is disposed on the downstream side of the first external heating roller 22 as seen from the fixing nip N3 and is press-contacted to the fixing roller 17 by being urged by an unshown urging mechanism. The second external heating roller 25 includes a metal core 25*a*, as a base layer, made of metal, such as aluminum or iron, and also includes a heat-resistant parting layer 25*c* which is coated on the surface of the metal core 25*a* by fluorine-containing material coating. The parting layer 25*c* of the second external heating roller 25 contains acetylene black, which is one type of carbon, as the electroconductive agent. The proportion of the electroconductive agent to the parting layer 25*c* is 7 wt. %.

By containing the electroconductive agent, the surface resistivity of the surface of the second external heating roller 25, i.e., of the parting layer 25*c* is adjusted at $1\times10^{7}$ Ω/sq. Further, the proportion of the electroconductive agent to the parting layer 25*c* is larger than that to the parting layer 22*c* of the first external heating roller 22 and therefore the contact angle with respect to water of the surface of the second external heating roller 25 is smaller than that of the surface of the first external heating roller 22. The surface of the second external heating roller 25 has the contact angle with respect to water of 85 degrees.

A heat source 26 is a heat generating element, such as the halogen heater or the like, incorporated into the first external heating roller 25 and infrared-heats an inner surface of the core metal 25*a* of the second external heating roller 25.

A thermistor 27 of a contact type detects the surface temperature in contact with the surface of the second external heating roller 25.

The temperature control device 20 controls an output of the heat source 26 on the basis of a detection result of the thermistor 27, so that the surface temperature of the second external heating roller 25 detected by the thermistor 27 is kept within a certain temperature range.

First and second cleaning rollers 29 and 30, which are en example of an external heating member cleaning means, are cylindrical cleaning members which rotate in press-contact with the first and second external heating rollers 22 and 25, respectively. The first and second cleaning rollers 29 and 20 are formed by providing surface layers 29*c* and 30*c* of a heat-resistant material having a rough surface shape such as felt, sponge or non-woven fabric, on surfaces of metal cores 29*a* and 29*b*, respectively.

The first cleaning roller 29 has the surface temperature lower than that of the first external heating roller 22 and therefore solidifies the toner deposited on the surface of the first external heating roller 22 in a melted state, thus taking the toner into its texture. Further, the second cleaning roller 30 has the surface temperature lower than that of the second external heating roller 25 and therefore solidifies the toner deposited on the surface of the second external heating roller 25 in the melted state, thus taking the toner into its texture.

<Embodiment1>

In Embodiment 1, the surface of the fixing roller 17 is temperature-controlled in the range of 200° C.±3° C. by the control portion 20. The surfaces of the first and second external heating rollers 22 and 25 are temperature-controlled in the range from 200° C. to 250° C. in accordance with the surface temperature of the fixing roller 17. The surface temperature of the pressing roller 21 which is contacted to and heated by the fixing roller 17 in the fixing nip N3 is about 150° C.

The parting layer 17*c* of the fixing roller 17 to be directly contacted to the unfixed toner image on the recording material S is required to have the high parting property in order to prevent an offset image defect, such that the toner on the recording material S is transferred and lowers the image quality. Further, the parting layer 17*c* of the fixing roller 17 to be directly contacted to the recording material S frequently is liable to be considerably worn and therefore is required to have an anti-wearing property.

Therefore, in Embodiment 1, the roller 17 employs the parting layer 17*c*, which is a "tube layer using a heat-shrinkable tube" having a parting property and an anti-wearing property which are higher than those of the parting layer which is the coat layer formed by the coating. Specifically, the parting layer 17*c* of the fixing roller 17 is formed by a 50 μm-thick PFA tube.

On the other hand, the layers 22*c* and 25*c* of the first and second external heating rollers 22 and 25 are not contacted to the recording material S, so that their anti-wearing property is not required to be as strong as that of the parting layer 17*c* of the fixing roller 17. However, in order to efficiently supply heat in contact with the surface of the fixing roller 17, a high thermal conductivity is required.

Further, when the parting layers 22*c* and 25*c* of the first and second external heating rollers 22 and 25 are contaminated, in some cases, not only is the thermal conductivity to the fixing roller 17 is lowered, but also the parting layer 17*c* of the fixing roller 17 is damaged and the surface property of the fixed image is impaired.

For this reason, the parting layers 22*c* and 25*c* of the first and second external heating rollers 22 and 25 are required to have a high parting property and to be excellent in thermal conductivity although the levels of these properties need not be as high as in the case of the parting layer 17*c* of the fixing roller 17.

Therefore, in Embodiment 1, with respect to the first and second external heating rollers 22 and 25, the parting layers 22*c* and 25*c* were formed by coating the fluorine-containing resin material, which contains electroconductive filler which is an example of an electroconductive substance, on the surface of the electroconductive cylindrical material. By using a coat layer of PTFE or PFA as the fluorine-containing resin material, the parting layers 22*c* and 25*c* of the first and second external heating rollers 22 and 25 can be formed. The coat layer of PTFE or PFA is, compared with the tube material of the same material, poor in surface smoothness and thus the parting property is somewhat inferior. However, the parting layers 22*c* and 25*c* can be formed with a small thickness, so that it is possible to realize a high thermal conductivity and a high discharging property. More specifically, the parting layers 22*c* and 25*c* of the first and second external heating rollers 22 and 25 are formed by a 10 μm-thick PTE coat layer.

<Electroconductivity>

At the surface of the fixing roller 17 covered with the insulating parting layer 17*c*, the electric charge can cause charge-up by conveyance of the recording material S in the fixing nip N3. In the fixing nip N3 in which the fixing roller 17 and the pressing roller 21 are press-contacted to each other, by the contact with the recording material S to be nip-conveyed, the parting layer 17*c* of the fixing roller 17 is electrically charged to a high potential. In the case where in which high-speed continuous image formation was continued for a long time in a low-humidity environment in which the charged-up electric charge was less liable to cause discharge, the charged potential of the parting layer 17*c* was increased, so that a scattering phenomenon that the unfixed toner image was disturbed immediately before the fixing nip N3 occurred in some instances.

In response, a method in which the electroconductive filler such as carbon black is mixed in the parting layer 17*c* and the elastic layer 17*b* of the fixing roller 17 to lower the resistance value and the metal core 17*c* is connected to the ground potential to discharge the charged electric charge has been proposed. However, in this case, the charge-up of the parting layer 17*c* can be prevented but the surface smoothness was lowered by the mixing of the electroconductive filler as the electroconductive substance to cause a deterioration of the parting property and thus an offset image defect was liable to occur. Further, the surface smoothness is lowered to cause a deterioration of the parting property, so that there also arises a problem that the anti-wearing property of the fixing roller 17 is lowered.

Further, a method in which the electroconductive filler is mixed in the parting layer 22*c* of the first external heating roller 22 to lower the resistance value and the metal core 22*a* is connected to the ground potential to discharge the charged electric charge has also been proposed. However, in this case, it was found that the toner in the melted state is carried on the first external heating roller 22 causing a deterioration in surface smoothness of the parting layer 22*c* to prevent contact with the fixing roller 17, and therefore, the necessary heating performance cannot be achieved in a short period.

That is, in order to provide the surface of the first external heating roller 22 with electroconductivity, the electroconductive filler such as carbon black is mixed in the parting layer 22*c*. As a result, due to the deterioration in surface smoothness, the lowering in parting property and the lowering in anti-wearing property occur.

Further, an experiment in which the same amount of electroconductive filler is mixed in both of the parting layers 22*c* and 25*c* of the first and second external heating rollers 22 and 25 to lower the resistance value and the metal cores 22*a* and 25*a* are connected to the ground potential was also conducted.

In this case, a large amount of toner, which has been deposited on the fixing roller 17 in the fixing nip N3, is deposited on the first external heating roller 22, and therefore, the amount of the toner to be deposited on the second external heating roller 25 is small. However, a large amount of toner was deposited on the parting layer 22*c* of the first external heating roller 22, so that the heating performance of the first external heating roller 22 was impaired in a short time.

For this reason, in Embodiment 1, the electroconductive filler is dispersed in the parting layer 25*c* of the downstream-side second external heating roller 25 to impart electroconductivity to the parting layer 25*c* and the metal core 25*c* of the second external heating roller 25 is connected to the ground potential.

On the other hand, the parting layer 22*c* of the first external heating roller 22 does not contain electroconductive filler and thus has an insulating property and has a contact angle with respect to water of about 110 degrees. However, the surface resistance of the fixing roller 17 including the thick parting layer 17*c* is $1\times10^{15}$ Ωsq which is higher than the surface resistance of $1\times10^{12}$-$1\times10^{14}$ Ωsq for the first external heating roller 22 including the thin parting layer 22*c*. On the other hand, the parting layer 25*c* of the second external heating roller 25 is adjusted to have the surface resistance of $1\times10^{7}$ Ω/sq and a contact angle with respect to water of about 95 degrees. Here, as the contact angle with respect to water is larger, and the parting property with respect to the toner is higher and thus the toner is less liable to be deposited.

In Embodiment 1, the parting property of the first external heating roller 22 is higher than that of the second external heating roller 25. As a result, a part of the toner deposited on the fixing roller 17 in the fixing nip N3 passes through the point of contact between the first external heating roller 22 and the fixing roller 17 and is transferred onto the second external heating roller 25. In this way, the toner on the fixing roller 17 is distributed on the first and second external heating rollers 22 and 25, and therefore, the heating performance of the first external heating roller 22 is ensured stably over a long term.

Incidentally, in this embodiment, the electroconductive agent is not contained in the parting layer 22*c* of the external heating roller 22, but it is also possible to provide the parting layer 22*c* with a surface resistivity of $1\times10^{11}$ Ω/sq by incorporating acetylene black so that the proportion to the parting layer 22*c* is 5 wt. %.

<Discharging Effect>

Figure 3:
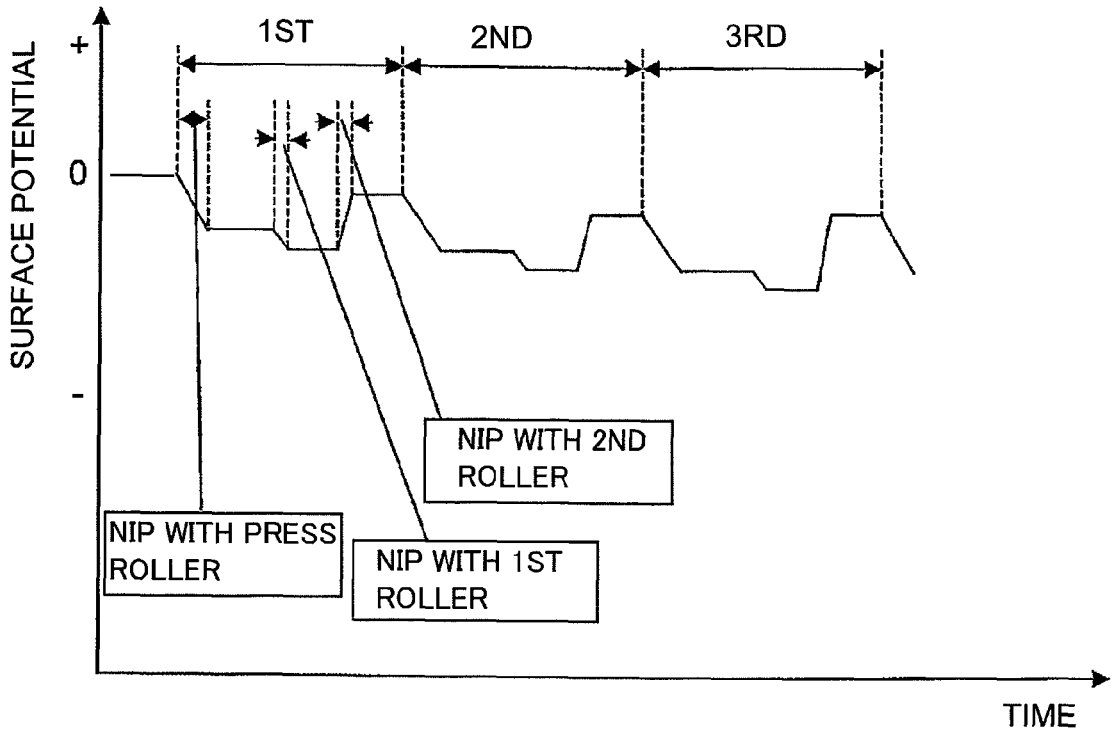
FIG. 3 is a graph for illustrating a change in surface potential of a fixing roller in the fixing device in Embodiment 1.
Figure 4:
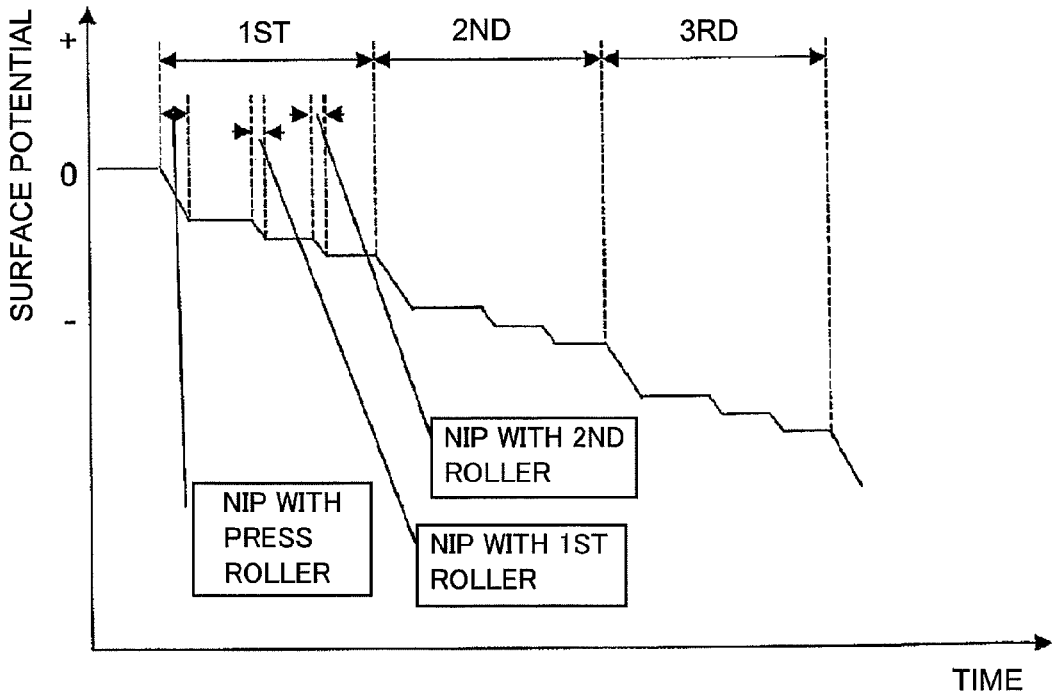
FIG. 4 is a graph for illustrating a change in surface potential of a fixing roller in a fixing device in a comparative embodiment.

FIG. 3 is a graph for illustrating a change in surface potential of the fixing roller in the fixing device in Embodiment 1, and FIG. 4 is a graph for illustrating a change in surface potential of a fixing roller in a fixing device in a comparative embodiment.

The fixing device in the comparative embodiment employs the second external heating roller 25 for which the parting layer 25*c* is formed similarly as in Embodiment 1, except that the electroconductive filler is not dispersed. That is, the fixing device performs the external heating by bringing the first and second external heating rollers 22 and 25, which have an insulating property and no discharging (charge-removing) performance, into contact with the fixing roller 17.

As shown in FIG. 3 with reference to FIG. 2, in the case of Embodiment 1 in which the parting layer 25*c* of the second external heating roller 25 is made electroconductive, the surface potential at a certain point on the surface of the fixing roller 17 approaches the ground potential with every passage through the point of contact with the second external heating roller 25.

The surface potential of the fixing roller 17 is increased on a minus (−) side, by the contact with the recording material S, for every passage through the fixing nip N3 between the fixing roller 17 and the pressing roller 21.

The surface potential of the fixing roller 17 is somewhat increased on the minus side by the contact between the parting layer 17*c* of the fixing roller 17 and the parting layer 22*c* of the first external heating roller 22 when a point on the fixing roller passes through the nip between the fixing roller 17 and the first external heating roller 22.

Thereafter, when a point on the fixing roller passes through the nip between the fixing roller 17 and the second external heating roller 25, the surface of the parting layer 17*c* of the fixing roller 17 is discharged and the surface potential is returned to about 0 V since the parting layer 25*c* of the second external heating roller 25 is made electroconductive.

Such a process of the charging and the discharging is repeated for every one rotation of the fixing roller 17, so that the surface potential of the fixing roller 17 is only increased up to about minus several hundred volts at the maximum. In the charge-up of about minus several hundred volts, the scattering phenomenon that the unfixed toner image carried on the recording material P is disturbed immediately before the fixing nip N3 is suppressed.

As shown in FIG. 4 with reference to FIG. 2, in the case of the comparative embodiment in which the second external heating roller 25 has no discharging performance, the surface potential at a certain point on the surface of the fixing roller 17 is continuously increased every rotation of the fixing roller 17.

The surface potential of the fixing roller 17 is increased on the minus (−) side, by the contact with the recording material S, for every passage through the fixing nip N3 between the fixing roller 17 and the pressing roller 21.

The surface potential of the fixing roller 17 is somewhat increased on the minus side by the contact between the parting layer 17*c* of the fixing roller 17 and the parting layer 22*c* of the first external heating roller 22 when a point on the fixing roller passes through the nip between the fixing roller 17 and the first external heating roller 22.

Thereafter, also when a point on the fixing roller passes through the nip between the fixing roller 17 and the second external heating roller 25, similarly as in the case where the point passes through the nip between the fixing roller 17 and the first external heating roller 22, the surface potential is somewhat increased on the minus side by the contact between the parting layer 17*c* of the fixing roller 17 and the parting layer 22*c* of the first external heating roller 22.

As a result, such a charging process is repeated every one rotation of the fixing roller 17, so that the surface potential of the fixing roller 17 can be finally increased up to about minus several kilo volts depending on the type of the recording material S, the image forming speed, the number of sheets subjected to the continuous image formation, and the ambient environment. Further, in this case, the scattering phenomenon that the unfixed toner image carried on the recording material S is disturbed immediately before the fixing nip N3 occurs.

Here, the relationships between the resistance values and the contact angles of the external heating rollers 22 and 25, and the resistance value and the contact angle of the fixing roller 17 in Embodiment 1 will be described. In Embodiment 1, the parting property of the surface of the first external heating roller 22 is lower than that of the surface of the fixing roller 17, but is higher than that of the surface of the second external heating roller 25. Therefore, when the contact angles with respected to water of the upstream-side first external heating member and the downstream-side second external heating member are $\alpha u$ and $\alpha d$, respectively, and when the contact angle with respect to water of the heating rotatable member is at, the relationship of: $\alpha t>\alpha u>\alpha d$ is satisfied.

Further, in Embodiment 1, the second external heating roller 25 located on the downstream side is higher in electroconductivity compared with the first external heating roller 22 located on the upstream side, and thus is connected to the ground potential. When the resistance values of the upstream-side and downstream-side external heating members are Ru and Rd, respectively, and when the resistance value of the heating rotatable member is Rt, the relationship of: Rt>Ru>Rd is satisfied.

Incidentally, the above-described contact angles and resistance values were measured in the following manners.

(Measurement of Contact Angle)

The contact angle of the roller was measured by using a contact angle meter ("CA-X Type", mfd. by Kyowa Interface Science Co., Ltd.) in accordance with an operation manual and by using ion-exchange water or commercially available purified water with respect to 12 points (longitudinal 3 points×circumferential 4 points). An average of the measured values was taken as the contact angle of the roller surface. A measurement environment was 23° C. and 60% RH.

(Measurement of Resistance)

The surface resistivity was measured in accordance with JIS-K6911 by using an ultra-high resistance meter ("R8340", mfd. by Advantest Corp.) after a good contact property between an electrode and the roller surface was obtained by using an electroconductive rubber as the electrode. A measuring condition included an applied voltage of 100 V and a voltage application time of 30 sec.

In Embodiment 1, the parting layer 22*c* of the first external heating roller 22 located on the upstream side with respect to the rotational direction of the fixing roller 17 when the fixing nip N3 is taken as a start point, has a smaller amount of the electroconductive filler than that of the parting layer 25*c*, thus having a high parting property. The parting layer 25*c* of the second external heating roller 25 located on the upstream side with respect to the rotational direction of the fixing roller 17 when the fixing nip N3 is taken as the start point has a larger amount of the electroconductive filler than the parting layer 22*c*, thus having a high electroconductivity.

In Embodiment 1, the toner and paper powder deposited on the fixing roller 17 are conveyed to the upstream-side first external heating roller 22 by the rotation of the fixing roller 17. Further, the surface of the fixing roller 17 has a parting property higher than that of the surface of the first external heating roller 22, and therefore, the toner which has been deposited on the fixing roller 17 is transferred onto the second external heating roller 22.

Further, the toner which has passed through the first external heating roller 22 is transferred onto the second external heating roller 25, having a parting property lower than that of the first external heating roller 22. By such a constitution, concentration of the deposited matter, such as the toner, at the first external heating roller 22 was prevented, so that it was possible to stabilize the heating performance of the first and second external heating rollers 22 and 25.

[Industrial Applicability]

According to the present invention, in the image heating apparatus using a plurality of the external heating members, it becomes possible to provide the image heating apparatus capable of maintaining the heating performance by the external heating members for a long term.

While the invention has been described with reference to the structures disclosed herein, it is not confined to the details set forth and this application is intended to cover such modifications or changes as may come within the purpose of the improvements or the scope of the following claims.

The invention claimed is:

1. An image forming apparatus comprising:

a heating rotatable member configured to heat a toner image on a recording material in a heating nip;

a pressing rotatable member configured to form the heating nip by contact with said heating rotatable member;

a first external heating member, contacting an outer peripheral surface of said heating rotatable member at a position that has passed through the heating nip, and configured to heat the outer peripheral surface of said heating rotatable member, wherein said first external heating member includes a parting layer at a surface where said first external heating member contacts the outer peripheral surface of said heating rotatable member; and a second external heating member configured to heat the outer peripheral surface of said heating rotatable member heated by said first external heating member, wherein said second external heating member includes a parting layer containing an electroconductive agent at a surface where said second external heating member contacts the outer peripheral surface of said heating rotatable member, wherein a contact angle of the parting layer of said first external heating member with respect to water is larger than that of the parting layer of said second external heating member, and a surface resistance of said second external heating member is lower than that of said first external heating member.

2. An image forming apparatus according to claim 1, wherein a contact angle of a surface of said heating rotatable member with respect to water is larger than that of the parting layer of said first external heating member.

3. An image forming apparatus according to claim 2, further comprising first cleaning means for removing toner deposited on a surface of said first external heating member and second cleaning means for removing the toner deposited on a surface of said second external heating member.

4. An image forming apparatus comprising:

a heating rotatable member configured to heat a toner image on a recording material in a heating nip;

a pressing rotatable member configured to form the heating nip by contact with said heating rotatable member;

a first external heating member, contacting an outer peripheral surface of said heating rotatable member at a position that has passed through the heating nip, and configured to heat the outer peripheral surface of the heating rotatable member, wherein said first external heating member includes a parting layer at a surface where said first external heating member contacts the outer peripheral surface of the heating rotatable member; and a second external heating member configured to heat the outer peripheral surface of the heating rotatable member heated by said first external heating member, wherein said second external heating member includes a parting layer containing an electroconductive agent at a surface where said second external heating member contacts the outer peripheral surface of the heating rotatable member, wherein a contact angle of the parting layer of said first external heating member with respect to water is larger than that of the parting layer of said second external heating member, and a proportion of the electroconductive agent to said parting layer of said second external heating member is larger than that of said first external heating member.

5. An image forming apparatus according to claim 4, wherein a contact angle of a surface of said heating rotatable member with respect to water is larger than that of the parting layer of said first external heating member.

6. An image forming apparatus according to claim 4, further comprising first cleaning means for removing toner deposited on a surface of said first external heating member and second cleaning means for removing the toner deposited on a surface of said second external heating member.

* * * * *